US010036341B2

(12) United States Patent
Kovac et al.

(10) Patent No.: US 10,036,341 B2
(45) Date of Patent: Jul. 31, 2018

(54) METHOD AND DEVICE FOR OPERATING A DRIVE SYSTEM FOR A MOTOR VEHICLE INCLUDING AN ACCELERATION MONITORING SYSTEM

(71) Applicant: Robert Bosch GmbH, Stuttgart (DE)

(72) Inventors: Dalibor Kovac, Vienna (AT); Gabor Pongracz, Vienna (AT); Matthias Schueler, Steinheim (DE); Tobias Soller, Ismaning (DE)

(73) Assignee: ROBERT BOSCH GMBH, Stuttgart (DE)

( * ) Notice: Subject to any disclaimer, the term of this patent is extended or adjusted under 35 U.S.C. 154(b) by 34 days.

(21) Appl. No.: 15/267,757

(22) Filed: Sep. 16, 2016

(65) Prior Publication Data

US 2017/0089287 A1 Mar. 30, 2017

(30) Foreign Application Priority Data

Sep. 25, 2015 (DE) ..... 10 2015 116 262

(51) Int. Cl.

| | |
|---|---|
| ***F02D 41/22*** | (2006.01) |
| ***F02D 41/00*** | (2006.01) |
| ***F02D 41/26*** | (2006.01) |
| ***F02D 41/04*** | (2006.01) |
| *F02D 11/10* | (2006.01) |

(52) U.S. Cl.

CPC ..... *F02D 41/222* (2013.01); *F02D 41/0097* (2013.01); *F02D 41/045* (2013.01); *F02D 41/26* (2013.01); *F02D 11/105* (2013.01); *F02D 2200/101* (2013.01); *F02D 2200/1012* (2013.01); *F02D 2200/501* (2013.01); *F02D 2200/602* (2013.01); *F02D 2250/26* (2013.01)

(58) Field of Classification Search

CPC ..... F02D 41/22; F02D 41/222; F02D 41/26; F02D 41/00; F02D 41/0097; F02D 2200/101

USPC ..... 701/101, 102, 110, 113–115; 73/114.04, 73/114.05, 114.23

See application file for complete search history.

(56) References Cited

U.S. PATENT DOCUMENTS

| | | | | |
|---|---|---|---|---|
| 3,953,080 | A * | 4/1976 | Bremer | B60T 8/1708 303/178 |
| 4,743,072 | A * | 5/1988 | Brearley | B60T 8/1708 303/128 |
| 6,351,703 | B1 * | 2/2002 | Avery, Jr. | B60R 25/04 123/179.2 |
| 2007/0112494 | A1 * | 5/2007 | Naik | B60K 31/0008 701/55 |
| 2010/0299045 | A1 * | 11/2010 | Moriya | F01M 1/16 701/102 |
| 2015/0361909 | A1 * | 12/2015 | Kuroki | F02D 29/02 701/101 |

(Continued)

*Primary Examiner* — John Kwon
*Assistant Examiner* — Johnny H Hoang
(74) *Attorney, Agent, or Firm* — Norton Rose Fulbright US LLP; Gerard Messina

(57) ABSTRACT

A method for operating a drive system including a drive engine for a motor vehicle, including carrying out an acceleration monitoring of the motor vehicle; switching to an alternative monitoring when a signal, which is relevant for the acceleration monitoring and for which a substitute signal exists, does not exist or has failed, and when a driver input which is below a predefined threshold value is specified, and/or a braking intent is specified.

9 Claims, 1 Drawing Sheet

(56) References Cited

U.S. PATENT DOCUMENTS

| | | | | |
|---|---|---|---|---|
| 2016/0230680 | A1* | 8/2016 | DeMarco | F02D 37/02 |
| 2016/0281669 | A1* | 9/2016 | Rychlinski | F02N 11/0818 |
| 2016/0298559 | A1* | 10/2016 | Matsushita | F02N 11/0862 |

* cited by examiner

METHOD AND DEVICE FOR OPERATING A DRIVE SYSTEM FOR A MOTOR VEHICLE INCLUDING AN ACCELERATION MONITORING SYSTEM

CROSS REFERENCE

The present application claims the benefit under 35 U.S.C. § 119 of German Patent Application No. DE 102015116262.8 filed on Sep. 25, 2015, which is expressly incorporated herein by reference in its entirety.

FIELD

The present invention relates to drive systems for motor vehicles, in particular to measures for carrying out an alternative monitoring during a monitoring for unintentional accelerations of the motor vehicle.

BACKGROUND INFORMATION

An error monitoring is provided in order to prevent an unintentional acceleration of the motor vehicle due to a software or hardware error in the engine control unit, for example. The error monitoring may include a torque-based, acceleration-based and/or power- or energy-based monitoring, in particular a three-level monitoring.

In the torque-based monitoring, a comparison of reference variables, which are generated via different torque-calculating paths, may be used for ascertaining a too high set point for a fuel quantity to be injected to the internal combustion engine, which may result in an unintentional acceleration of the vehicle, i.e., which is not intended by the driver.

In an acceleration-based monitoring, a signal from an acceleration sensor in the motor vehicle is evaluated. For this purpose, the actual vehicle acceleration, as well as the rotational acceleration of the drive train and of the wheels, which is calculated from the measured rotational speeds, is compared to a permissible acceleration. The permissible acceleration is calculated from the driver input, the requirements of driver assistance systems and external control units, braking torques, and tractional resistances.

If an actual acceleration is ascertained, in an acceleration monitoring, which is higher than the permissible acceleration and if this is not attributable to certain general conditions which may erroneously cause an error detection, an unintentional acceleration of a motor vehicle is detected and an error response is triggered, in which the drive system is shifted into an error response operating mode. The error response operating mode may provide that the rotational speed of the drive engine is limited to a maximum permissible engine speed. The maximum permissible engine speed may result from a specified driver input, in particular an accelerator pedal position of an accelerator pedal actuated by the driver of the motor vehicle. The maximum permissible engine speed is forwarded, e.g., to a maximum speed controller which ascertains a limiting torque to which the engine torque requested by the engine control unit is limited, on the basis of a difference between the accelerator pedal-dependent, maximum permissible engine speed and the instantaneous engine speed. If the maximum permissible engine speed is nevertheless exceeded by more than a certain rotational speed offset, e.g., due to an error in the rotational speed controller, an injection fade-out may be additionally requested. If injections continue to take place nevertheless and the engine speed remains above the permissible, accelerator pedal-dependent maximum speed, a safety shutoff of the output stage controlling the fuel injectors may be carried out and an engine shutoff may be initiated.

In certain situations, the acceleration monitoring may also erroneously indicate an error or an acceleration which is too high, e.g., when the actual tractional resistances are substantially lower than is assumed, e.g., on the basis of models, for the calculation of the permissible acceleration. Since the acceleration monitoring is not meaningful in these cases, a switch to an alternative monitoring function initially takes place and, there, the error-free operation is monitored in these situations as well. If the error is also confirmed in the alternative monitoring, the above-described error response is triggered.

If a substitute signal, e.g., calculated from the wheel speed sensors, is used as the acceleration signal instead of the signal from an acceleration sensor, there is a need to continue to provide safety and robustness of the acceleration monitoring system.

SUMMARY

According to the present invention, a method for operating a drive system including an acceleration monitoring system of the vehicle and a device and a drive system are provided.

According to a first aspect of the present invention, a method for operating a drive system including at least one drive engine for a motor vehicle is provided, including the following steps:

- carrying out an acceleration monitoring of the motor vehicle, whereby the monitoring may be torque-based, acceleration-based and/or power- or energy-based;
- switching into an alternative monitoring
  - when a signal, which is relevant for the acceleration monitoring and for which a substitute signal exists, does not exist or has failed, and
  - when a driver input which is below a predefined threshold value is specified, and/or a braking intent is specified.

In addition, the signal which is relevant for the acceleration monitoring may correspond to a longitudinal acceleration signal detected by an acceleration sensor or an inertial sensor, and the substitute signal may correspond to a substitute acceleration signal ascertained by a wheel speed sensor, in particular on a secondary axle.

One objective of the above-described method is to maintain the functionality of an acceleration monitoring system in the event of the failure of a signal which is relevant for carrying out the acceleration monitoring. In addition, the above-described method is also usable in drive systems in which a signal required for the acceleration monitoring cannot be obtained due to a lack of a corresponding sensor.

In the previous method for the acceleration-based monitoring, in the event of the failure of a signal which is relevant for an acceleration monitoring, such as, for example, a signal for the vehicle longitudinal acceleration or for the vehicle speed, a switch to an alternative monitoring takes place as described above, in which, e.g., a speed limitation which is dependent on a specified driver input is active. In a certain driving situation, the alternative monitoring may represent a considerable limitation of the drivability of the motor vehicle, and this should be avoided as far as possible.

In order to avoid the switch to the alternative monitoring and to carry out the monitoring function despite the failure of a signal which is relevant for carrying out the acceleration monitoring, it is provided that the acceleration monitoring is carried out on the basis of a substitute signal for the signal which is relevant for the acceleration monitoring. As substitute signals for the signals which are relevant for the acceleration monitoring, i.e., the longitudinal acceleration signal and the speed signal, which are provided by an acceleration sensor or an inertial sensor, the signals may be used, which are provided by a sensor coupled to the secondary axle (a non-driven axle), as the substitute acceleration signal or the substitute speed signal. When a substitute acceleration signal resulting from the rotation of the secondary axle is used as the acceleration sensor signal, it must be taken into account that the substitute acceleration signal resulting from the wheel speeds during travel on uphill grades and downhill grades deviates from the actual vehicle longitudinal acceleration, since acceleration components caused by gravity are also included in the wheel speeds. Therefore, an adaptation of the monitoring method for the acceleration monitoring is necessary. The method provides that the criteria for the switch into and out of the alternative monitoring are adapted when there is a failure of or an error in the signal which is relevant for the acceleration monitoring. In this way, the alternative monitoring is switched to when the condition that a signal, which is relevant for the acceleration monitoring and for which a substitute signal is available, does not exist or has failed, and the condition that a driver input is specified which is below a predefined threshold value and/or a braking intent is specified, are simultaneously met.

As compared to the previous acceleration-based monitoring method, in which the alternative monitoring is always switched to when a relevant signal fails, in the method described above, the alternative monitoring is necessarily switched to significantly less often in the event of a failure of a signal which is relevant for the acceleration monitoring and for which a substitute signal exists.

In addition, the method may be carried out cyclically, so that an alternative monitoring which has already been engaged is exited again when the check of the drive system has been successfully carried out and the acceleration monitoring system no longer reports that a limit has been exceeded, and a specified driver input is present.

It may be provided that the alternative monitoring is engaged when a signal, which is relevant for the acceleration monitoring and for which a substitute signal is available, does not exist or has failed and when an unintentional acceleration of the motor vehicle is detected on the basis of the substitute signal.

In addition, a switch to the alternative monitoring may not be carried out or, if this has already been switched to, the alternative monitoring may be exited again when, on the basis of the substitute signal, an unintentional acceleration of the motor vehicle is not detected and a driver input which is above a predefined threshold value is simultaneously specified, and a braking intent is not present.

In addition, the alternative monitoring may include a limitation of the engine speed to a value which is dependent on the driver input.

Alternatively or additionally, the alternative monitoring may include a limitation of the engine torque to a value which is dependent on the driver input.

BRIEF DESCRIPTION OF THE DRAWINGS

Specific embodiments are described in greater detail in the following with reference to the figures.

DETAILED DESCRIPTION OF EXAMPLE EMBODIMENTS

Figure 1:
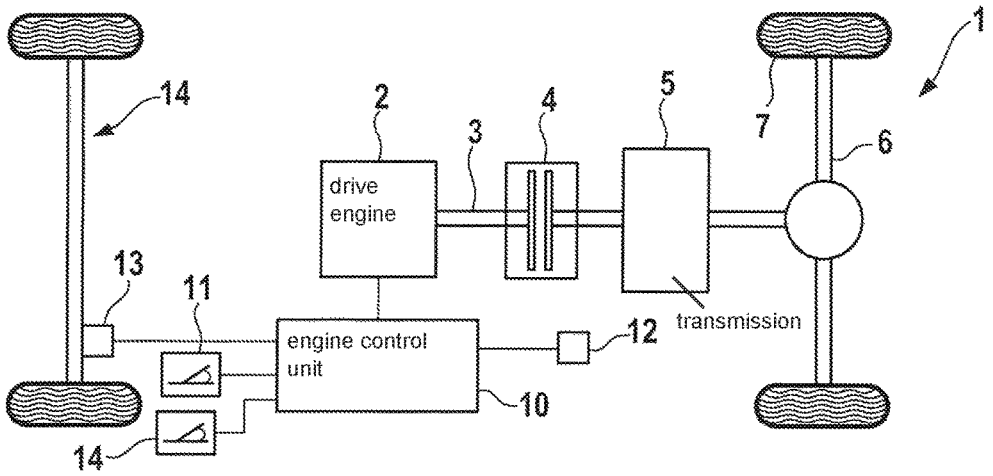
FIG. 1 shows a schematic representation of a drive system for a motor vehicle.

FIG. 1 shows a schematic representation of a drive system 1 including a drive engine 2 including an output shaft 3 which is coupled via a clutch 4 and a transmission 5 to a drive shaft 6 for driving drive wheels 7. Drive engine 2 may be designed as an internal combustion engine, in particular as an air-guided internal combustion engine, and may be operated by an engine control unit 10.

Engine control unit 10 may be coupled to an accelerator pedal 11 in order to receive a piece of information regarding an accelerator pedal position which specifies a driver input, e.g., in the form of a driver-input torque desired by the driver. During regular operation, the driver input resulting from the accelerator pedal position is converted, in engine control unit 10, into a set point torque according to torque path functions, and the set point torque is specified to control output stages, corresponding to a fuel injection quantity for controlling fuel injectors of internal combustion engine 2.

A monitoring function which may carry out an acceleration monitoring of the torque path functions is provided. In an acceleration-based monitoring, a check is carried out to determine whether the acceleration of the motor vehicle, in which drive system 1 is utilized, does not exceed (or does so by no more than a tolerance value) a permissible acceleration. For this purpose, an actual vehicle longitudinal acceleration which is measured and made available as a longitudinal acceleration signal, e.g., with the aid of an acceleration sensor 12 (inertial sensor), is compared with the permissible acceleration. The permissible acceleration may be calculated from the driver input, the requirements of driver assistance systems and external control units, braking torques, a rotational acceleration of drive train 6 and wheels 7, which is calculated from measured rotational speeds, and tractional resistances. If an increase results, from which it may be inferred that an unintentional acceleration of the motor vehicle is taking place, an alternative monitoring is switched to or an error response operating mode is engaged.

It may be provided that the monitoring function is carried out on the basis of a substitute signal if a signal required for the acceleration monitoring fails. As substitute signals for the monitoring-relevant signals, i.e., the longitudinal acceleration signal for the vehicle longitudinal acceleration and the speed signal for the vehicle speed, which are determined with the aid of the signal from acceleration sensor 12, the substitute acceleration signal may be used, which results from the wheel speed of a secondary axle 14, i.e., a non-driven wheel axle, or the substitute speed signal may be used, which results from the wheel speed of secondary axle 14. For this purpose, a wheel speed sensor 13 may be provided on secondary axle 14 in order to measure a wheel speed or wheel acceleration. Wheel speed sensor 13 may be situated at the drive wheels or on a secondary axle 14 which is not driven.

In addition, a brake pedal 14 or any other type of device may be provided in order to communicate a braking intent to control unit 10.

Figure 2:
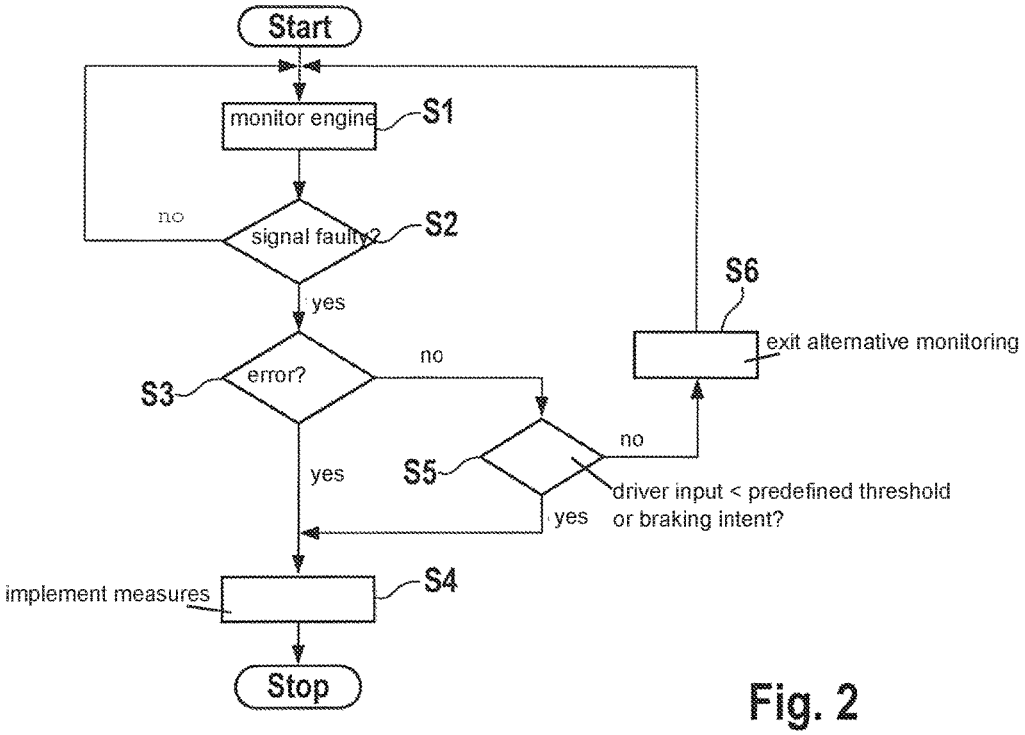
FIG. 2 shows a flow chart for illustrating a monitoring function for operating the drive system including an alternative monitoring system.

In control unit 10, both the acceleration monitoring as well as the alternative monitoring is carried out, and control for the error operation mode is carried out. The method for operating the acceleration monitoring system is schematically represented in the flow chart in FIG. 2.

The following description relates to a method which is based on a conventional acceleration monitoring of the motor vehicle. The acceleration monitoring is based on a comparison between an actual and a permissible acceleration using a torque-based, acceleration-based and/or power- or energy-based conversion.

In step S1, the acceleration monitoring is carried out in a conventional manner. If an error is detected therein, an error operation mode is engaged, which provides for, e.g., an emergency operation or a shutoff of engine system 1.

In step S2, a check is carried out within the scope of the acceleration monitoring to determine whether a signal, which is relevant for the acceleration monitoring, is faulty or has failed. If a sensor, such as, e.g., acceleration sensor 12, has failed (alternative: Yes), the longitudinal acceleration signal originally provided for determining the vehicle acceleration on the basis of the vehicle longitudinal acceleration is not available and the method is continued with step S3; otherwise (alternative: No) the method returns to step S1.

If a signal, which is relevant for the acceleration monitoring, has failed, then, instead, a vehicle acceleration of the vehicle may be derived from wheel speed sensor 13, which is provided as a substitute acceleration signal, and so there is no need to automatically switch to the error operation mode. The vehicle acceleration in the form of the substitute acceleration signal may be fairly precisely determined from wheel speed sensor 13 for the cases in which the motor vehicle moves on a level road section and the wheels are not blocked by brakes. For travel on uphill grades and downhill grades, however, the vehicle acceleration calculated from the wheel speeds differs from the vehicle longitudinal acceleration determined by acceleration sensor 12, since the acceleration components caused by gravity are also included in the substitute acceleration signal which is ascertainable from the wheel speeds. In order to safely and robustly monitor for unintentional acceleration despite these differences between the longitudinal acceleration signal and the substitute acceleration signal, which was ascertained as a substitute, an adaptation of the monitoring method is necessary.

The vehicle acceleration, which is established as a substitute acceleration signal via wheel speed sensor 13, generally corresponds, during travel on a level road section, to the actual vehicle longitudinal acceleration. If an impermissible acceleration is then detected in the acceleration monitoring system on the basis of the vehicle acceleration determined from the alternatively ascertained substitute acceleration signal, it must be assumed that the acceleration is actually unintentional and the alternative monitoring must be carried out. However, it is not possible to establish that traveling is taking place on a level road section based solely on the substitute acceleration signal.

If the vehicle is traveling on a downhill grade, the substitute acceleration signal is greater than the longitudinal acceleration signal would be, provided an acceleration sensor is available and functional, due to the additionally acting component of gravity due to the downhill grade. Therefore, it cannot be differentiated whether there is an impermissible acceleration in the horizontal or on a slight downhill grade, or if there is error-free operation and on a steeper downhill grade. Since travel on a level road section and travel on a downhill grade may not be differentiated on the basis of the substitute acceleration signal, a switch to the alternative monitoring takes place independently thereof when an impermissible acceleration is detected.

When the substitute acceleration signal indicates lower vehicle acceleration than the longitudinal acceleration signal during travel on an uphill grade, an impermissible acceleration may be detected only with a delay. If the vehicle acceleration indicated by the substitute acceleration signal is only so great that the overall acceleration during travel on the uphill grade is less than or equal to the vehicle acceleration which would result in the case of an identical driver input in a case of error-free operation during travel on a level road section, the vehicle acceleration cannot be detected. If the impermissible absolute value is greater, then only the absolute value which exceeds the permissible acceleration during travel on a level road section may result in an error detection, which is possibly greatly delayed.

A high unintentional acceleration may also be detected during travel on an uphill grade, since the component of the acceleration resulting from gravity is significantly less than the component of the actual acceleration of the motor vehicle. Therefore, when an impermissible acceleration occurs on an uphill grade and, due to the use of a substitute acceleration signal, cannot be detected, or may only be detected after a long delay, it may be assumed that the resultant acceleration is low enough that the driver may respond thereto in a timely manner by discontinuing the actuation of the accelerator pedal or by actuating the brakes, without a safety-critical state being reached.

For this purpose, a check is carried out in step S3 to determine whether the acceleration monitoring based on the substitute signal results in an error. If this is the case (alternative: Yes), the error operation mode is engaged in step S4 and appropriate measures are implemented. Otherwise, the method is continued with step S5.

In step S5, a check is carried out to determine whether the driver is specifying a driver input which is less than a predefined threshold value, or is specifying a braking intent. If this is the case (alternative: Yes), the method is continued with the error operation mode being engaged in step S4. Otherwise (alternative: No), the method is continued with step S6. Since a compensation of an unintentional acceleration by a brake actuation during travel on an uphill grade cannot be reliably differentiated from a normal braking operation during travel on a level road section, a switch to the alternative monitoring always takes place in the event of a braking intent by the driver.

The monitoring function therefore provides that the monitoring function is carried out on the basis of the substitute signal when a signal, which is relevant for the acceleration monitoring and for which a substitute signal exists, has failed. If an error is detected in this case or if a driver input which is below a predefined threshold value is detected, or if an actuation of brake pedal 14 is detected, a switch to the alternative monitoring takes place.

In step S6, the alternative monitoring is exited again. In this way, the alternative monitoring may be exited again when the monitoring function does not detect an erroneous acceleration of the motor vehicle on the basis of the substitute acceleration signal, and a greater driver input is present.

As compared to the previous monitoring method, in which the alternative monitoring is always switched to when an error occurs, in the method described above, the alternative monitoring is necessarily switched to significantly less often in the event of a failure of a signal which is relevant for the acceleration monitoring and for which a substitute signal exists. In addition, the method may be carried out cyclically, so that an alternative monitoring which has already been engaged may be exited again when the acceleration monitoring system no longer reports that a limit has been exceeded, and a driver input which is above the predefined threshold value is present, and a braking intent is not present.

What is claimed is:

1. A method of operating an engine of a motor vehicle, the method comprising:

obtaining, by processing circuitry, inputs identifying whether a braking request is present and identifying driver-input drive requests;

cyclically performing, by the processing circuitry, an acceleration monitoring that includes checking whether there is an unintentional acceleration of the motor vehicle, wherein the acceleration monitoring is performed by executing an algorithm that:

defines to determine whether the unintentional acceleration is present using a primary check based on signals of a first sensor that indicates a longitudinal acceleration of the vehicle when no fault is detected in the first sensor and its output signals, and without using a secondary check;

defines to determine whether the unintentional acceleration is present using the secondary check based on signals of a second sensor in response to satisfaction of a first condition that (a) a fault is detected in the first sensor or its output signals and (b) the inputs indicate that the braking request is present;

defines to determine whether the unintentional acceleration is present using the secondary check in response to satisfaction of a second condition that (a) the fault is detected in the first sensor or its output signals and (b) the inputs indicate that an identified driver-input drive request is below a predefined threshold value;

defines to determine whether the unintentional acceleration is present using the secondary check in response to satisfaction of a third condition that (a) the fault is detected in the first sensor or its output signals and (b) an unintentional acceleration is indicated to be present by the primary check using a substitute vehicle longitudinal acceleration value that is obtained by reconstructing the longitudinal acceleration of the vehicle using a signal of a third sensor; and defines that the unintentional acceleration is not present, independent of the secondary check, in response to a combination of (a) the fault being detected in the first sensor or its output signals, (b) no braking request being indicated to be present by the inputs, (c) the identified driver-input drive request not being below the predefined threshold value, and (d) the unintentional acceleration being indicated not to be present by a result of the primary check using the substitute vehicle longitudinal acceleration value; and modifying, by the processing circuitry, an operation of the engine in response to a result of the acceleration monitoring being that the unintentional acceleration is present.

2. The method as recited in claim 1, wherein the secondary check is not performed when there is a combination of conditions that (a) a result of the primary check using the substitute signal is obtained without detection of the unintentional acceleration, the driver-input drive request is not below the predefined threshold value, and the braking request is not present.

3. The method as recited in claim 1, wherein the secondary check includes comparing a speed of the engine to a value which is dependent on driver input.

4. The method as recited in claim 1, wherein the secondary check includes comparing of a torque of the engine to a value which is dependent on driver input.

5. The method as recited in claim 1, wherein the third sensor is a wheel speed sensor on a primary or secondary axle.

6. A drive system of a motor vehicle, the drive system comprising:

a first sensor, output signals of which indicate a longitudinal acceleration of the vehicle;

a second sensor;

a third sensor;

an engine; and processing circuitry;

wherein:

the processing circuitry is configured to obtain inputs identifying whether a braking request is present and identifying driver-input drive requests;

the processing circuitry is configured to cyclically perform an acceleration monitoring that includes checking whether there is an unintentional acceleration of the motor vehicle;

the acceleration monitoring is performed by executing an algorithm that:

defines to determine whether the unintentional acceleration is present using a primary check based on signals of the first sensor when no fault is detected in the first sensor and its output signals, and without using a secondary check;

defines to determine whether the unintentional acceleration is present using the secondary check based on signals of the second sensor in response to satisfaction of a first condition that (a) a fault is detected in the first sensor or its output signals and (b) the inputs indicate that the braking request is present;

defines to determine whether the unintentional acceleration is present using the secondary check in response to satisfaction of a second condition that (a) the fault is detected in the first sensor or its output signals and (b) the inputs indicate that an identified driver-input drive request is below a predefined threshold value;

defines to determine whether the unintentional acceleration is present using the secondary check in response to satisfaction of a third condition that (a) the fault is detected in the first sensor or its output signals and (b) an unintentional acceleration is indicated to be present by the primary check using a substitute vehicle longitudinal acceleration value that is obtained by reconstructing the longitudinal acceleration of the vehicle using a signal of the third sensor; and defines that the unintentional acceleration is not present, independent of the secondary check, in response to a combination of (a) the fault being detected in the first sensor or its output signals, (b) no braking request being indicated to be present by the inputs, (c) the identified driver-input drive request not being below the predefined threshold value, and (d) the unintentional acceleration being indicated not to be present by a result of the primary check using the substitute vehicle longitudinal acceleration value; and the processing circuitry is configured to modify an operation of the engine in response to a result of the acceleration monitoring being that the unintentional acceleration is present.

7. A non-transitory computer-readable medium on which are stored instructions that (1) are executable by a processor of a motor vehicle that includes an engine, a first sensor that outputs signals that indicate a longitudinal acceleration of the vehicle, a second sensor, and a third sensor, and (2) when executed by the processor, cause the processor to perform a method of operating the engine of the motor vehicle, the method comprising:

obtaining inputs identifying whether a braking request is present and identifying driver-input drive requests;

cyclically performing an acceleration monitoring that includes checking whether there is an unintentional acceleration of the motor vehicle, wherein the acceleration monitoring is performed by executing an algorithm that:

defines to determine whether the unintentional acceleration is present using a primary check based on signals of the first sensor when no fault is detected in the first sensor and its output signals, and without using a secondary check;

defines to determine whether the unintentional acceleration is present using the secondary check based on signals of the second sensor in response to satisfaction of a first condition that (a) a fault is detected in the first sensor or its output signals and (b) the inputs indicate that the braking request is present;

defines to determine whether the unintentional acceleration is present using the secondary check in response to satisfaction of a second condition that (a) the fault is detected in the first sensor or its output signals and (b) the inputs indicate that an identified driver-input drive request is below a predefined threshold value;

defines to determine whether the unintentional acceleration is present using the secondary check in response to satisfaction of a third condition that (a) the fault is detected in the first sensor or its output signals and (b) an unintentional acceleration is indicated to be present by the primary check using a substitute vehicle longitudinal acceleration value that is obtained by reconstructing the longitudinal acceleration of the vehicle using a signal of the third sensor; and defines that the unintentional acceleration is not present, independent of the secondary check, in response to a combination of (a) the fault being detected in the first sensor or its output signals, (b) no braking request being indicated to be present by the inputs, (c) the identified driver-input drive request not being below the predefined threshold value, and (d) the unintentional acceleration being indicated not to be present by a result of the primary check using the substitute vehicle longitudinal acceleration value; and modifying an operation of the engine in response to a result of the acceleration monitoring being that the unintentional acceleration is present.

8. A method of operating an engine of a motor vehicle, the method comprising:

obtaining, by processing circuitry, inputs identifying whether a braking request is present and identifying driver-input drive requests;

cyclically performing, by the processing circuitry and while no fault is detected in a first sensor that indicates a longitudinal acceleration of the vehicle and in its output signals, a primary acceleration monitoring that includes checking whether there is an unintentional acceleration of the motor vehicle based on the signals of the first sensor;

upon occurrence of a fault in the first sensor or in its signals:

determining, by the processing circuitry and based on the inputs, that at least one of the braking request is present and a driver-input drive request identified by the inputs is below a predefined threshold value; and responding to the determination that the at least one of the braking request is present and the driver-input drive request identified by the inputs is below the predefined threshold value by performing, by the processing circuitry, a secondary acceleration monitoring that includes checking whether there is an unintentional acceleration of the motor vehicle based on signals of a second sensor; and modifying, by the processing circuitry, an operation of the engine in response to a result of the secondary acceleration monitoring being that the unintentional acceleration is present, wherein the processing circuitry is configured to also modify the operation of the engine whenever a result of the primary acceleration monitoring, performed while no fault is detected in the first sensor and its output signals, is that the unintentional acceleration is present.

9. A method of operating an engine of a motor vehicle, the method comprising:

cyclically performing, by the processing circuitry and while no fault is detected in a first sensor that indicates a longitudinal acceleration of the vehicle and in its output signals, a primary acceleration monitoring that includes checking whether there is an unintentional acceleration of the motor vehicle based on the signals of the first sensor;

respond to an occurrence of a fault in the first sensor or in its signals by:

continuing, by the processing circuitry, performance of the primary acceleration monitoring using signals of a second sensor, instead of the first sensor, by reconstructing the longitudinal acceleration of the vehicle using the signals of the second sensor;

obtaining, by the processing circuitry, a result of the primary acceleration monitoring using the signals of the second sensor that indicates that the unintentional acceleration of the motor vehicle is present;

in response to the result, performing, by the processing circuitry, a secondary acceleration monitoring that includes checking whether the unintentional acceleration of the motor vehicle is present based on signals of a third sensor; and in response to a result of the secondary acceleration monitoring indicating that the unintentional acceleration of the motor vehicle is present, modifying, by the processing circuitry, an operation of the engine.

* * * * *